US006629336B2

(12) United States Patent
Hosaka et al.

(10) Patent No.: US 6,629,336 B2
(45) **Date of Patent: *Oct. 7, 2003**

(54) ORIGINAL PRESSING PLATE HINGE

(75) Inventors: Hiroaki Hosaka, Kanagawa (JP); Hirofumi Kohda, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/174,704

(22) Filed: Jun. 19, 2002

(65) Prior Publication Data

US 2002/0152580 A1 Oct. 24, 2002

Related U.S. Application Data

(62) Division of application No. 09/456,578, filed on Dec. 8, 1999, now Pat. No. 6,415,477.

(30) Foreign Application Priority Data

Dec. 11, 1999 (JP) ..... 10-353409

(51) Int. Cl.[7] ..... E05D 11/10

(52) U.S. Cl. ..... 16/327; 16/289; 16/284; 16/286

(58) Field of Search ..... 16/327, 335, 286, 16/284, 292, 289; 355/75; 399/379

(56) References Cited

U.S. PATENT DOCUMENTS 2,743,476 A * 5/1956 Turner ..... 16/289
3,103,693 A * 9/1963 Tenniswood et al. ..... 16/289
3,496,595 A * 2/1970 Larson ..... 16/289
3,906,587 A * 9/1975 Little ..... 16/289
4,091,502 A * 5/1978 Little ..... 16/273
4,310,948 A * 1/1982 Rock et al. ..... 16/288
4,312,097 A * 1/1982 Boyd ..... 16/279
4,365,893 A * 12/1982 Kimura et al. ..... 16/332
4,800,624 A * 1/1989 Whitefoot et al. ..... 16/332
5,337,448 A * 8/1994 Brown ..... 16/284
5,541,712 A * 7/1996 Fujitaka et al. ..... 355/75
5,621,501 A * 4/1997 Matsuo et al. ..... 355/75
6,100,963 A * 8/2000 Hosaka ..... 355/75
6,327,457 B1 * 12/2001 Hashimoto ..... 355/75
6,415,477 B1 * 7/2002 Hosaka et al. ..... 16/327

* cited by examiner

*Primary Examiner*—Anthony Knight
*Assistant Examiner*—John B. Walsh
(74) *Attorney, Agent, or Firm*—Notaro & Michalos P.C.

(57) ABSTRACT

In an original pressing plate hinge including a fixing member, an original pressing plate supporting member pivotably installed via a hinge pin to the fixing member, a slider slidably housed in the supporting member, a cam member fixed between the slider and the free end of the supporting member in contact with the slider, and a coil spring provided resiliently between the slider and the free end of the supporting member, the cam member is omitted to prevent an original or document set on the platen glass for copying or printing from being stained with or spoiled by a lubricant when the original touches the cam member to which the lubricant sticks, and instead a pressure receiving pin is used and a cam slider is used in place of the slider. To prevent a heavy original pressing plate from abruptly falling, a fluid damping member is housed in the coil spring and disposed between the cam slider and the top plate or free end of the supporting member.

8 Claims, 10 Drawing Sheets

ORIGINAL PRESSING PLATE HINGE

CROSS-REFERENCE TO RELATED APPLICATIONS

This is a divisional of application Ser. No. 09/456,578 filed Dec. 8, 1999 and now U.S. Pat. No. 6,415,477 and incorporated here by reference, which claims priority on Japanese application number 10-353,409 filed Dec. 11, 1998, which claim is repeated for the present application.

BACKGROUND OF THE INVENTION

1. Field of the Invention

The present invention relates to a hinge suitable for use with an original pressing plate of a copying machine, printing machine or the like to open and close the original pressing plate.

2. Description of the Prior Art

Various types of original pressing plate hinges have ever been proposed. A typical one of them includes a fixing member to be installed to the body of an object provided with an original pressing plate, such as a copying machine or the like, and on which the hinge is to be used, a supporting member to support the original pressing plate, pivotably installed via a hinge pin to the fixing member, a slider housed slidably in the supporting member, a cam member fixed between opposite lateral plates of the fixing member in contact with the slider, and a coil spring provided resiliently between the slider and the free end of the supporting member.

Another typical one of them includes a fixing member to be installed to the body of an object provided with an original pressing plate, such as a copying machine or the like, on which the hinge is to be used, a supporting member to support the original pressing plate, pivotably installed via a hinge pin to the fixing member, a slider housed slidably in the supporting member, a cam member fixed between opposite lateral plates of the fixing member in contact with the slider, a coil spring provided resiliently between the slider and the free end of the supporting member, and a damping member housed in the coil spring to be put into action when a heavy original pressing plate, if applied, is closed to a predetermined angular position, to thereby prevent the original pressing plate from falling abruptly.

In the above-mentioned conventional original pressing plate hinges including the cam member and slider, a lubricant has to be applied to the surface of the cam member fixed between the opposite lateral plates of the fixing member. When the original pressing plate is opened or closed with an original set on a platen glass or contact glass, for copying or printing, the surface of the cam member applied with the lubricant is exposed so that the end of the original placed on the platen glass may possibly touch the lubricant on the cam member if the original is moved out of place, and thus the original is likely to be stained with or spoiled by the lubricant.

Also, in the above-mentioned conventional original pressing plate hinge using the damping member, once the hinge is assembled, the damping member cannot easily be removed or accessed because it is housed in the coil spring also housed in the supporting member.

Further, the supporting member of each of the above conventional original pressing plate hinges is pivotably installed via the hinge pin to the fixing member fixed to the body of the object on which the hinge is to be used. Therefore, if the fixing member has bearing members made of a non-conductive material such as synthetic resin and in which the hinge pin is pivotably supported, no electrical connection can be provided between the object and the original pressing plate provided with an automatic document or original feeder, for example.

OBJECT AND SUMMARY OF THE INVENTION

Accordingly, it is an object of the present invention to overcome the above-mentioned drawbacks of the prior art by providing an original pressing plate hinge constructed, with no cam member fixed to the fixing member, to avoid that the cam member surface applied with the lubricant would otherwise be exposed towards the original placed on the platen glass as in the conventional original pressing plate hinges.

It is another object of the present invention to provide an original pressing plate hinge using a slider housed in a supporting member and whose cam surface needs not to be lubricated, that is, a so-called lubricant-free original pressing plate hinge.

It is a still another object of the present invention to provide an original pressing plate hinge which attains the above objects and further includes a damping member.

It is a yet another object of the present invention to provide an original pressing plate hinge of which a damping member can freely be removed even after the hinge itself is assembled or after it is installed to the body of an object having an original pressing plate and on which the hinge is to be used.

It is a still yet another object of the present invention to provided an original pressing plate hinge including a fixing member having bearing members made of a non-conductive material and in which a hinge pin is pivotably supported, an electrical connection being assured between the fixing member and supporting member.

The above object can be attained by providing an original pressing plate hinge including:

- a fixing member consisting of a base plate, which is to be fixed to the body of an object provided with an original pressing plate and on which the hinge is to be used, opposite lateral plates rising from opposite lateral sides of the base plate;
- a supporting member to support the original pressing plate and which consists of a back plate, top plate formed by bending the back plate, opposite lateral plates, and holding plates formed by bending the opposite lateral plates, one end of each of the opposite lateral plates of the supporting member being pivotably installed via a hinge pin to outside of the opposite side plates of the fixing member;
- a cam slider having one end thereof formed as a cam-shaped portion and which is slidably held by holding plates of the supporting member and directed towards the fixing member;
- a pressure receiving pin supported between the opposite lateral plates of the fixing member in contact with the cam portion of the cam slider;
- a coil spring provided resiliently between the cam slider and the top plate of the supporting member;
- slots formed on the opposite lateral plates for receiving the holding plates when the supporting member is closed; and
- a lifting member for attaching to the original pressing plate which is pivoted to a free end of the supporting member.

Also, the above object can be attained by providing an original pressing plate hinge including:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the free end of the supporting member; and a fluid damping member with a piston rod removably inserted from the top plate of the supporting member into the coil spring, it being activated as a damper with the piston rod caused to abut at the end thereof the cam slider when the supporting member is closed to a predetermined angular position as the original pressing plate is closed.

Also, the above object can be attained by providing an original pressing plate hinge including:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin being in contact with the cam portion of the cam slider and supported between the opposite lateral plates of the fixing member;

a coil spring provided resiliently between the cam slider and the free end of the supporting member; and a fluid damping member having a piston rod and inserted in the coil spring, it being activated as a damper with the piston rod caused to abut at the end thereof the cam slider when the supporting member is closed to a predetermined angular position as the original pressing plate is closed.

Also, the above object can be attained by providing an original pressing plate hinge including:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the top plate of the supporting member; and a fluid damping member with a piston rod and inserted in the coil spring, it being activated as a damper with the piston rod caused to abut at the end thereof the cam slider when the supporting member is closed to a predetermined angular position as the original pressing plate is closed.

Also, the above object can be attained by providing an original pressing plate hinge including:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the free end of the supporting member; and a fluid damping member having a piston rod and inserted between the cam slider in the coil spring and the free end of the supporting member, it being activated as a damper with the piston rod caused to abut at the end thereof the cam slider when the supporting member is closed to a predetermined angular position as the original pressing plate is closed.

Also, the above object can be attained by providing an original pressing plate hinge including:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the top plate of the supporting member; and a fluid damping member with a piston rod, inserted between the cam slider in the coil spring and the top plate of supporting member, it being activated as a damper with the piston rod caused to abut at the end thereof the cam slider when the supporting member is closed to a predetermined angular position as the original pressing plate is closed.

Also, in any one of the above-mentioned original pressing plate hinges, the supporting member may further include a frictional portion which is put in contact with the cam slider when the supporting member is closed to a predetermined angular position as the original pressing plate is closed, thereby controlling the sliding movement of the cam slider.

Also, in any one of the above-mentioned original pressing plate hinges, the fixing member may have bearing members made of a non-conductive material and in which the hinge pin is pivotably supported, a conductive material shaped like a coil spring and being used to electrically connect the supporting member and fixing member to each other.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
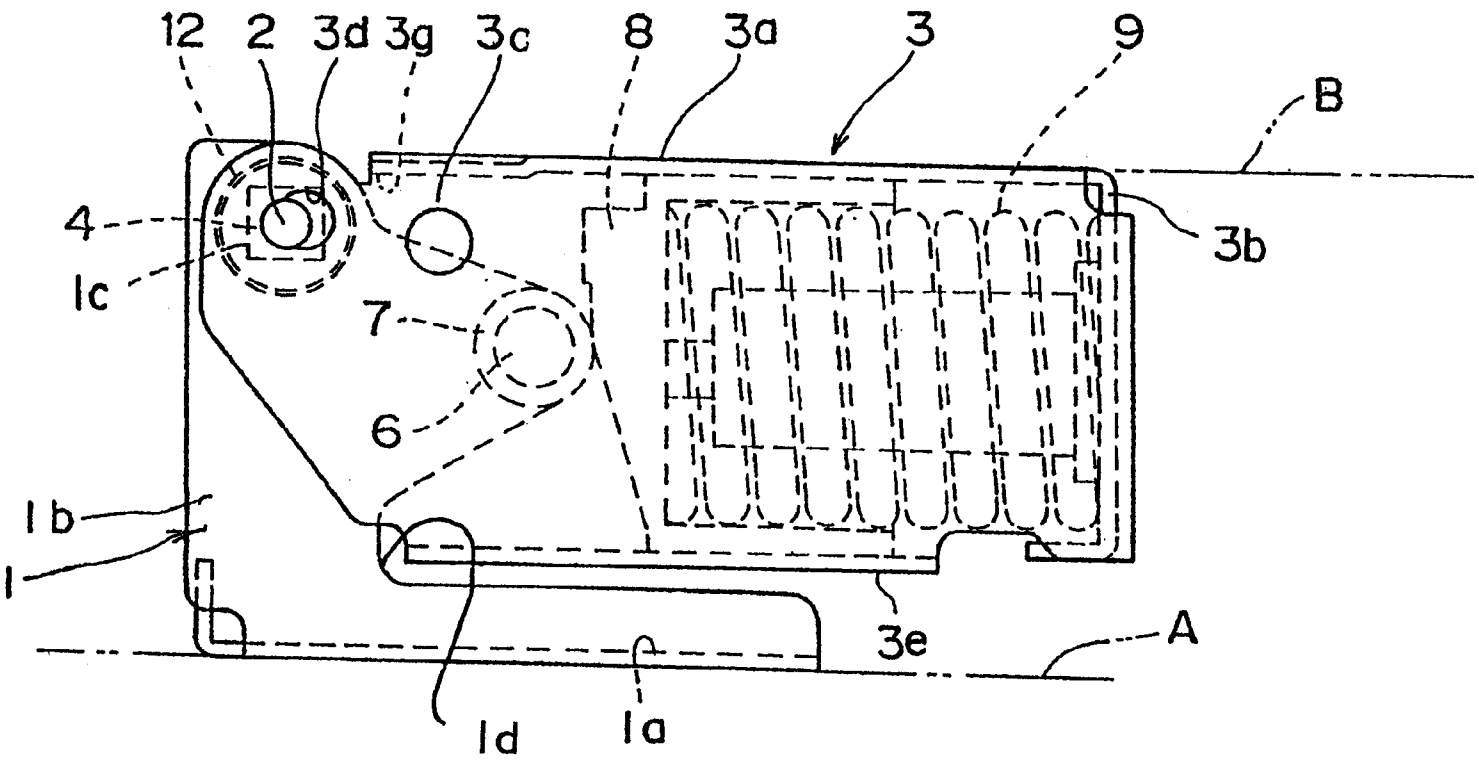
FIG. 1 is a side elevation of the original pressing plate hinge according to the present invention.
Figure 2:
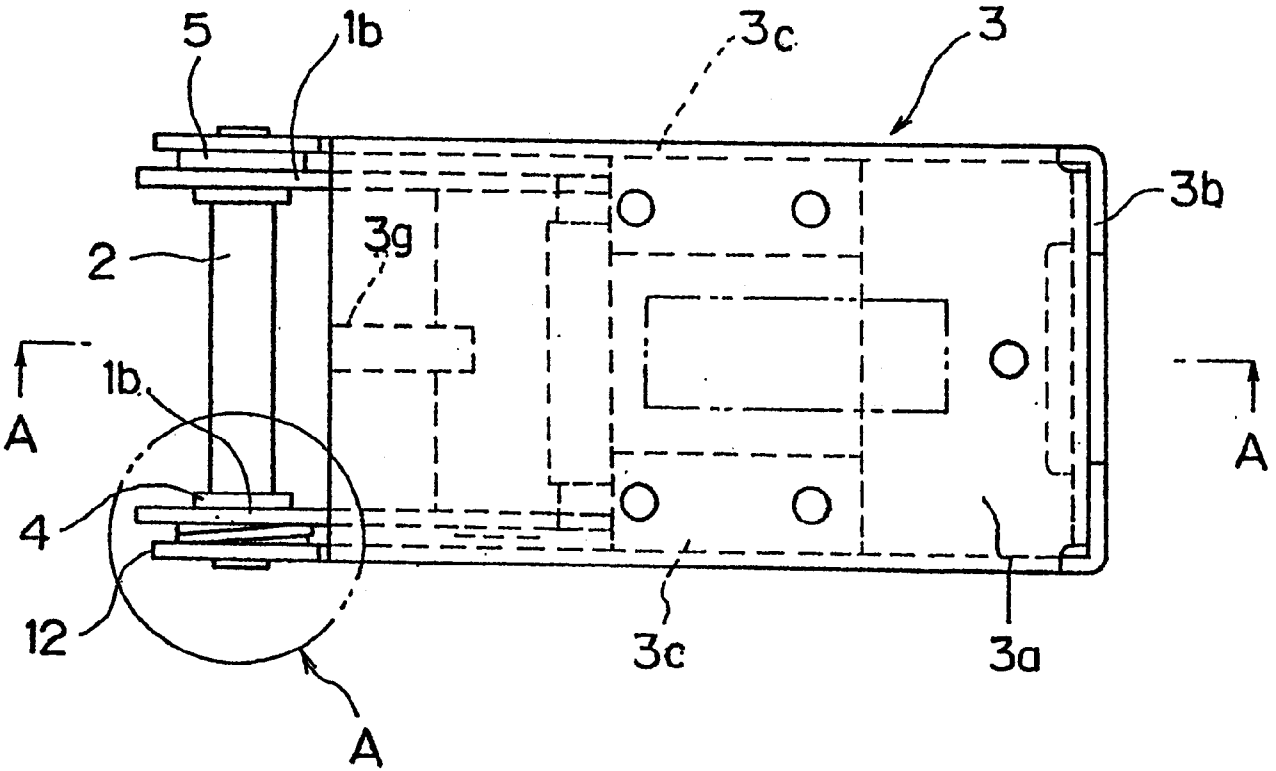
FIG. 2 is a plan view of the original pressing plate hinge according to the present invention.
Figure 3:
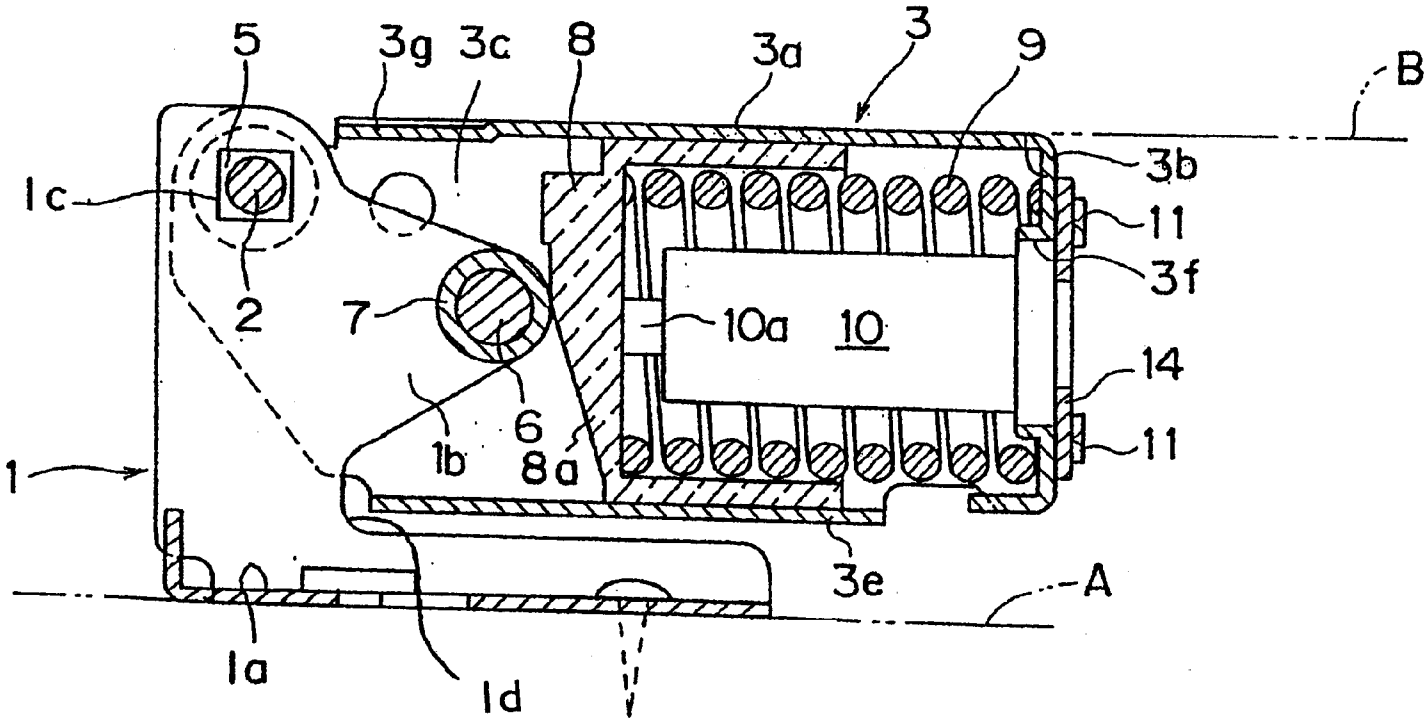
FIG. 3 is a sectional view taken along the line A—A in FIG. 2.
Figure 4:
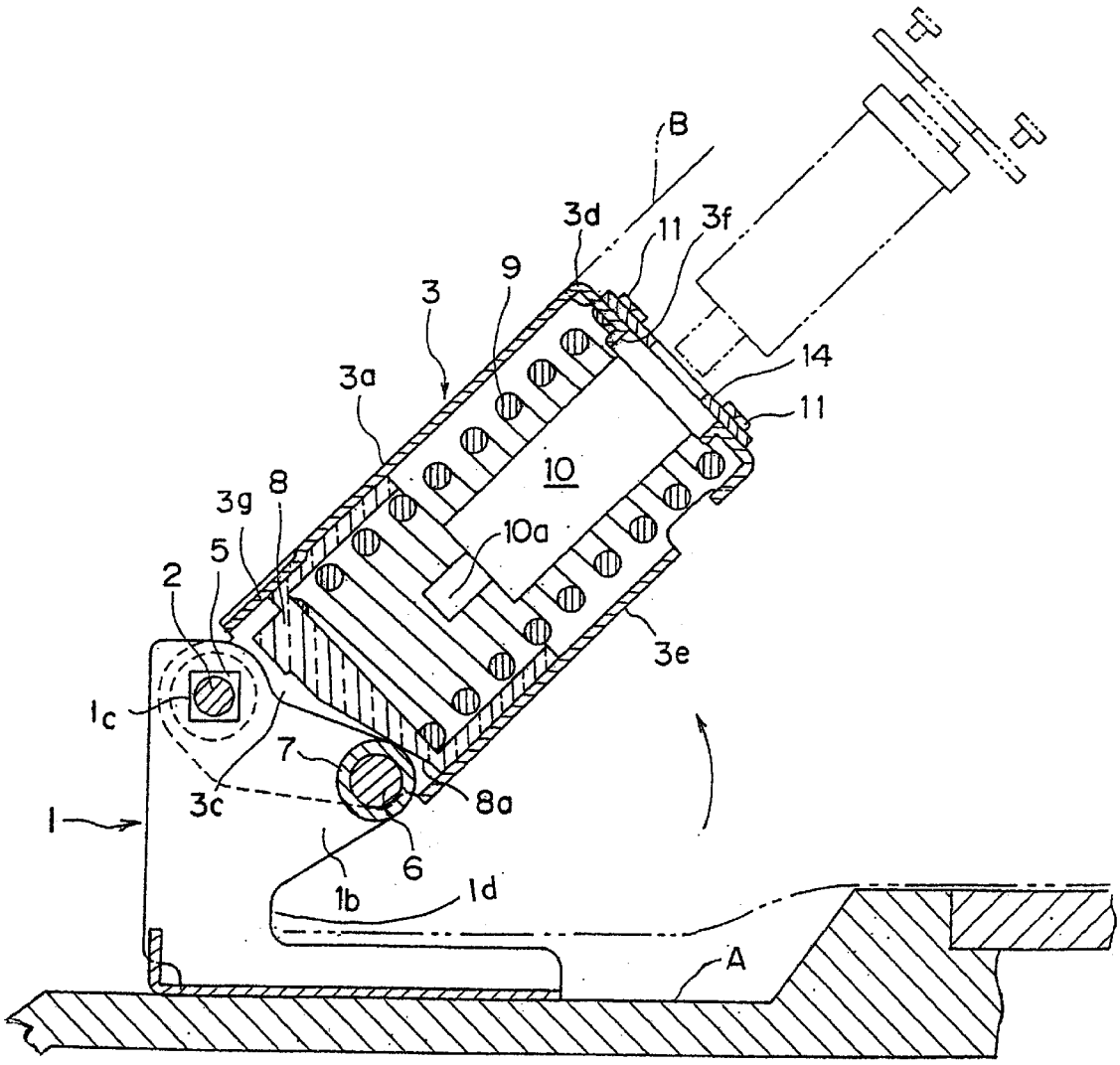
FIG. 4 is a side elevation, partially sectional, of the original pressing plate in an opened position.
Figure 5:
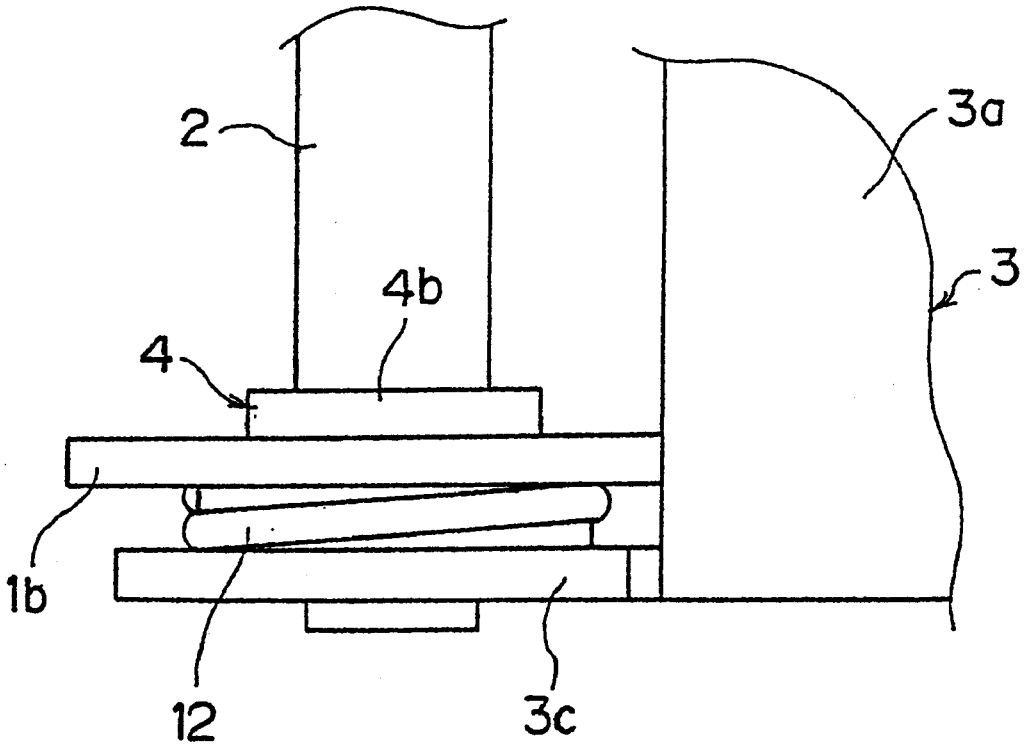
FIG. 5 is an enlarged view of the portion A in FIG. 2.
Figure 6:
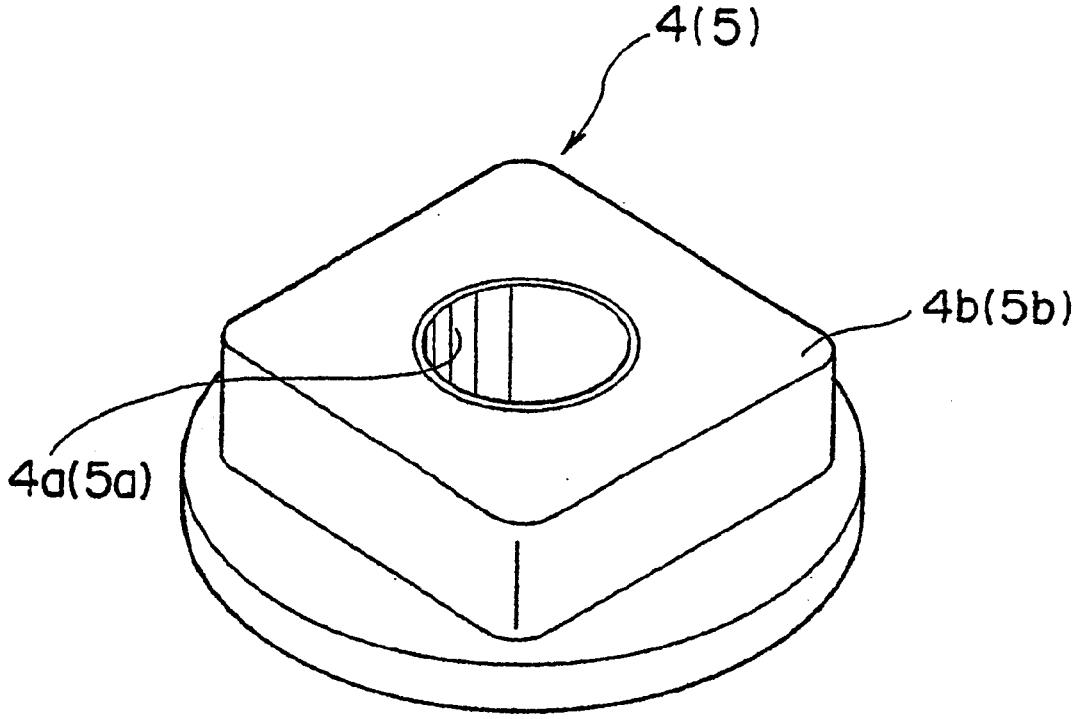
FIG. 6 is a perspective view of the bearing members.

Referring now to FIGS. 1 to 6, there is illustrated the first embodiment of the original pressing plate hinge according to the present invention. The hinge includes a fixing member 1 formed from a conductive metal plate consisting of a base plate 1*a*, opposite lateral plates 1*b* rising from opposite lateral sides of the base plate 1*a*, and slots formed on the opposite lateral plates 1*b*. The fixing member 1 is to be installed to the body, indicated with an imaginary line A, of an object provided with an original pressing plate whose rear portion is indicated with an imaginary line B, and on which the hinge is to be used, such as a copying machine, printing machine or the like. The hinge further includes a supporting member formed from a conductive metal plate consisting of a back plate 3*a*, top plate 3*b* formed by bending the back plate 3*a*, opposite lateral plates 3*c*, and holding plates 3*e* by bending the opposite lateral plates 1*b*. The opposite lateral plates 3*c* are pivoted at one end thereof via a hinge pin 2 to the opposite lateral plates 1*b*. respectively, of the fixing member 1. Thus, the opposite lateral plates 1*b* of the fixing member 1 are linked via the hinge pin 2 to the outside of the corresponding opposite lateral plates 3*c*, respectively, of the supporting member 3. The rear portion B of the original pressing plate is fixed to the back plate 3*a* of the supporting member 3. The opposite lateral plates 3*c* of the supporting member 3 have elongated bearing holes 3*d* (only one of them is shown in FIG. 1 for the simplicity of the illustration) formed at positions thereof where they are pivoted via the hinge pin 2 to the opposite lateral plates 1*b*. Owing to this elongated shape of the bearing holes 3*d*, the supporting member 3 can easily be installed in place or removed from there. Bearing members 4 and 5 formed from a non-conductive material such as POM, for example, are fitted non-rotatably on the portions of the hinge pin 2, supported on the opposite lateral plates 1*b*, respectively, of the fixing member 1. The bearing members 4 and 5 have formed therein bearing holes 4*a* and 5*a*, respectively, in which the hinge pin 2 is inserted and supported. Each of the bearing members 4 (5) has formed thereon a fixing portion 4*a* (5*a*) having a generally square section. The square fixing portion 4*a* (5*a*) is inserted and fixed in a corresponding one of square fixing holes 1*c* (only one of them is shown in FIGS. 1 and 3 for the simplicity of the illustration) formed in the opposite lateral plates 1*b*, respectively, of the fixing member 1. Note that the shapes of the bearing holes 4*a* and 5*a* as well as the sectional shapes of the fixing portions 4*b* and 5*b* of the bearing members 4 and 5 are not limited to the one (square) as in this embodiment but may be triangular, pentagonal, semi-circular, elliptic, etc. as necessary. Also note that the material of the bearing members is not limited to POM but may be any other non-conductive material such as ceramic, etc. or a conductive material such as a metal, which would be appropriate, as necessary. Further, between one of the opposite lateral plates 1*b* of the fixing member 1 and one of the opposite lateral plates 3*c* of the supporting member 3, opposite to the opposite lateral plate 1*b*, there is provided a coil spring-shaped conductive material 12 on the hinge pin 2 and bearing member 4, for example. The coil spring-shaped conductive material 12 is in contact with both the lateral plates 1*b* and 3*c* to assure an electrical connection between the fixing member 1 and supporting member 3.

The opposite lateral plates 1*b* of the fixing member 1 have a shaft 6 fixed non-rotatably thereto at a position different from the position where the hinge pin 2 is provided (namely, at a forward position in this embodiment). A roller 7 made of a synthetic resin such as POM is fitted rotatably on the shaft 6. Namely, the roller 7 is cylindrical. Note that the shaft 6 may be supported between the opposite lateral plates 1*b* to be rotatable itself. Also note that the material of the roller 7 is not limited to POM but may be any one selected from an oil-impregnated rein, ceramic, rubber and metal, which would be appropriate, as necessary. A lubricant is applied between the roller 7 and shaft 6 and an arrangement is made for the lubricant not to leak out to the surface of the roller 7.

The supporting member 3 further consists of holding plates 3*e* (only one of them is shown for the simplicity of the illustration), in addition to the back plate 3*a*, top plate 3*b* and opposite side plates 3*c*. A cam slider 8 is held by the holding plates 3*e* and housed slidably in the supporting member 3. The cam slider 8 has a cam portion 8*a* sloping in one direction and on which the roller 7 rolls.

Between the cam slider 8 and top plate 3*b* of the supporting member 3, there is resiliently provided a coil spring 9 which presses to the roller 7 the cam slider 8 which will force the supporting member 3 in the direction of opening the original pressing plate B or in the direction of closing the original pressing plate B after the latter has been closed to a predetermined angular position.

The top plate 3*b* of the supporting member 3 has formed therein an insertion hole 3*f* through which a damping member 10 of a well-known construction using a viscous fluid, for example, is inserted into the coil spring 9. The damping member 10 includes a piston rod 10*a*. The damping member 10 is inserted first at the piston rod 10*a* thereof into the coil spring 9. There is also provided a fixing plate 14 which is removably fixed to the top plate 3*b* with screws 11. Thus, the damping member 10 can be removed even after the hinge is assembled and installed to the object body such as a copying machine.

Further, the back plate 3*a* of the supporting member 3 is depressed inwardly to form a step which provides a braking portion 3*g* the cam slider 8 sliding inside the supporting member 3 will abut when the original pressing plate B is opened to a predetermined angular position. Note that the braking portion 3*g* may not always be provided in the above position but may be provided at any other appropriate position and that it may be omitted as necessary.

The original pressing plate hinge constructed as having been described in the foregoing functions as will be described below:

As shown in FIGS. 1 and 3, since the line of action of the coil spring 9 coincides with the axis of the shaft 6 having the roller 7 fitted thereon when the original pressing plate B is closed, the supporting member 3 is not forced in neither the opening nor closing direction of the original pressing plate B. Namely, the original pressing plate B is stably closed. At this time, the piston rod 10*a* of the damping member 10 is abutting the inner bottom of the cam slider 8. Note that the line of action of the coil spring 9 may be displaced below the axis of the shaft 6 or the cam portion 8*a* formed on one end of the cam slider 8 can be changed in form to force the supporting member 3 in the direction of opening original pressing plate B.

As the original pressing plate B is opened by hand from the closed position shown in FIGS. 1 and 3, the roller 7 will rotate and move from the high portion of the cam portion 8*a* of the cam slider 8 towards the low portion, so that the original pressing plate B will have its own weight reduced under the effect of resilience of the coil spring 9. Namely, the original pressing plate B can be opened with less force.

When the original pressing plate B thus opened is released with the hand taken off, the roller 7 will have to roll on the ascending slope of the cam portion 8*a* of the cam slider 8 forced in one direction by the coil spring 9. Since this climbing on the ascending slope will be a resistance to the roller 7, a rotation moment the original pressing plate B creates about the hinge pin 2 by means of the supporting member 3, the resilience of the coil spring 9 and a torque the cam slider 8 abutting the roller 7 creates are balanced among them. In this embodiment, when the original pressing plate B is opened to an angular position of more than 30 deg., it is stopped and held stably. At this time, the end of the piston rod 10*a* of the damping member 10 is off the inner bottom of the cam slider 8.

As the original pressing plate B is opened, the braking portion 3*g* is pressed to the cam slider 8 to brake the latter, to thereby prevent the original pressing plate B from abruptly being opened or widen the stable holding range allowed for the original pressing plate B.

When the original pressing plate B is closed, the inertia will add to the closing speed. However, when the original pressing plate B is closed to near a predetermined angular position (about 20 deg. in this embodiment), the end of the piston rod 10*a* of the damping member 10 will start abutting the cam slider 8 and the damping member 10 will start working. The rotation of the supporting member 3 is thus controlled to prevent the original pressing plate B from abruptly being closed. The slots 1*d* receive the holding plates 3*e* when the supporting member 3 is closed.

Note that the present invention is not applied only to the original pressing plate hinge having been illustrated and described in the going, but can be applied as it is to any other original pressing plate hinge of such a type as having a lifting member, Z1 in FIG. 10 if applied, of an original pressing plate pivoted at 22 to the free end of the supporting member as described in the claims defined later. In this case, one end of the coil spring 9 is arranged not to abut the top plate 3*b* of the supporting member 3 but to beyond the fulcrum of the lifting member, and thus it will press the lifting member in a direction of overlapping the back plate 3*a* of the supporting member 3.

Figure 7:
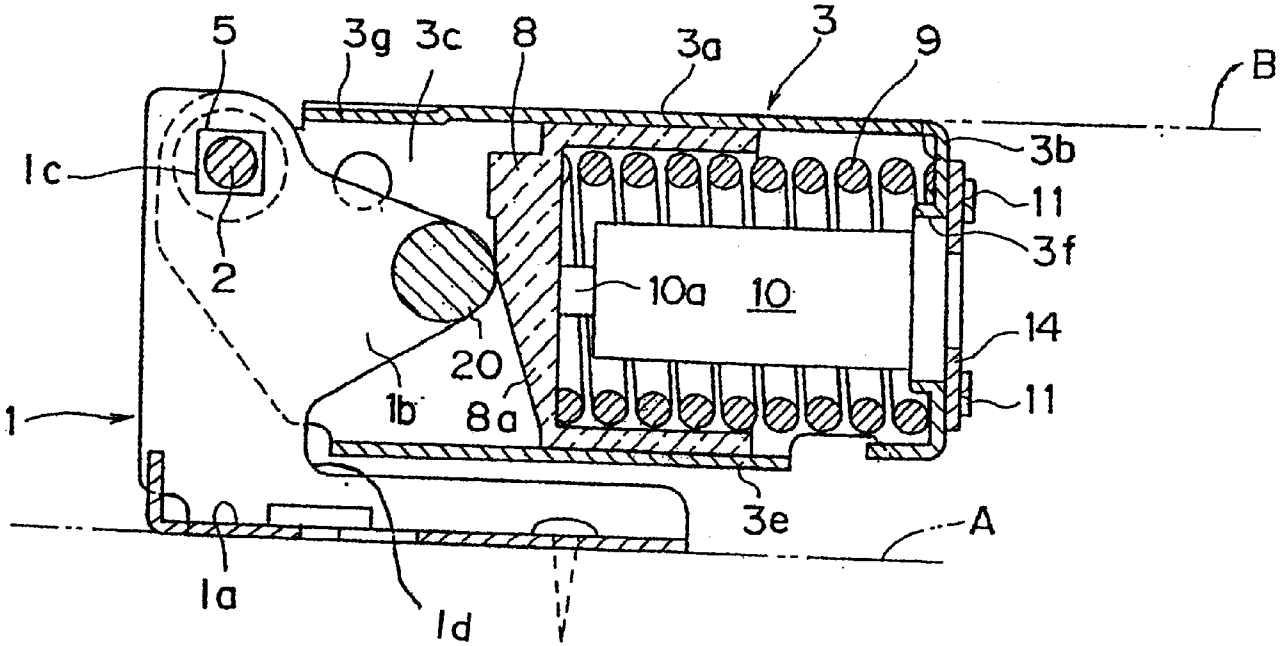
FIG. 7 is a side elevation, partially sectional, of another embodiment of the original pressing plate hinge according to the present invention.
Figure 8:
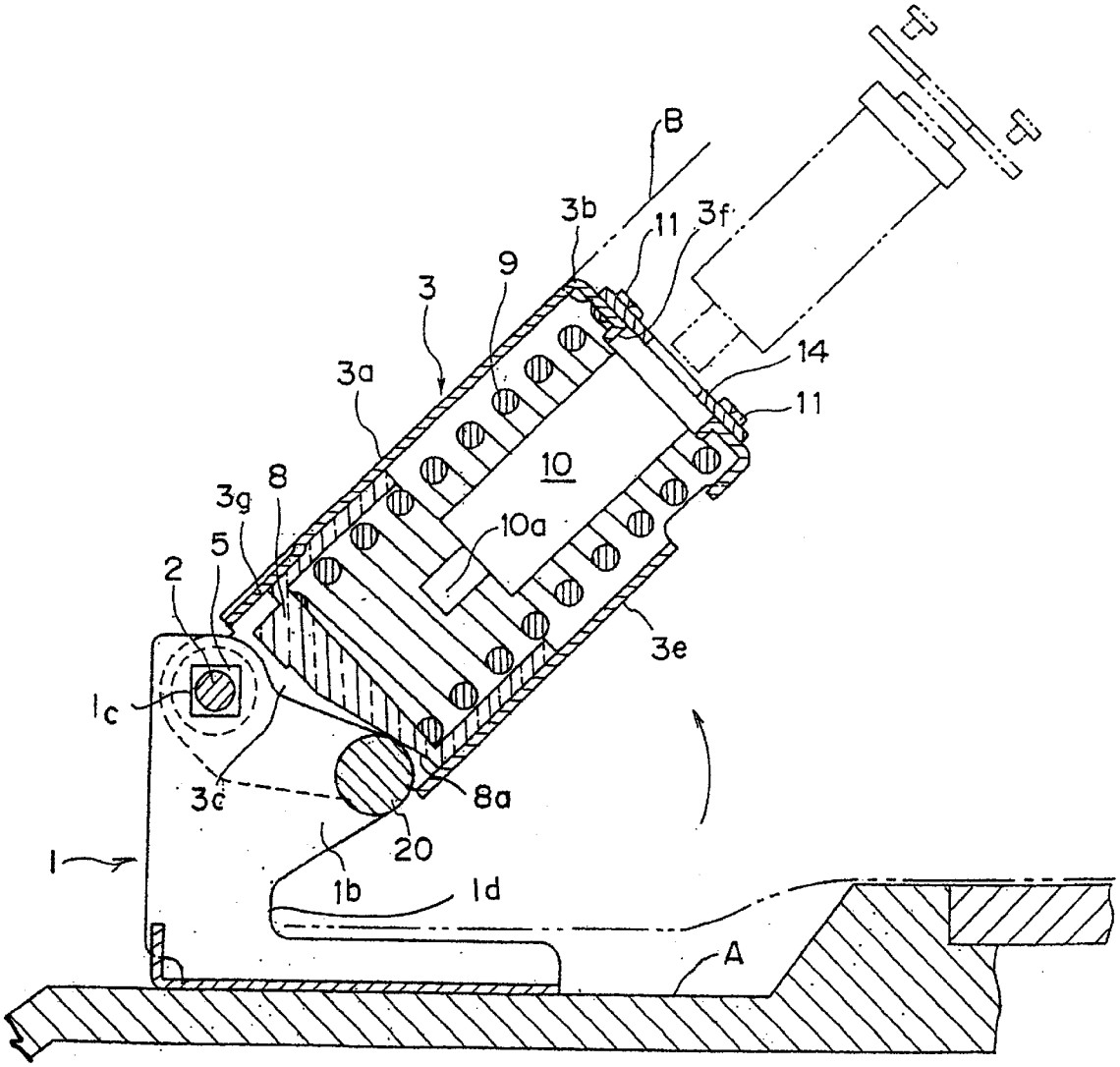
FIG. 8 is a side elevation, partially sectional, of the original pressing plate hinge in FIG. 7, when in an opened position.

Referring now to FIGS. 7 and 8, there is illustrated the second embodiment of the original pressing plate hinge according to the present invention. This second embodiment is similar to the aforementioned first embodiment except that a pressure receiving pin 20 is used in place of the roller 7 non-rotatably supported between the opposite lateral plates 1*b* of the fixing member 1 and abutting the cam portion 8*a* of the cam slider 8.

In this embodiment, a lubricant is used on the cam portion 8*a* of the cam slider 8 as the case may be and will stick to the surface of the pressure receiving pin 20. However, since the pressure receiving pin 20 will seldom be exposed towards the platen glass when the original pressing plate B is opened, as will best shown in FIG. 8, there is not a likelihood that the end of the original or document placed on the platen glass for copying or printing will touch the pressure receiving pin 20 having the lubricant stuck thereto and will thus be stained with the lubricant.

Figure 9:
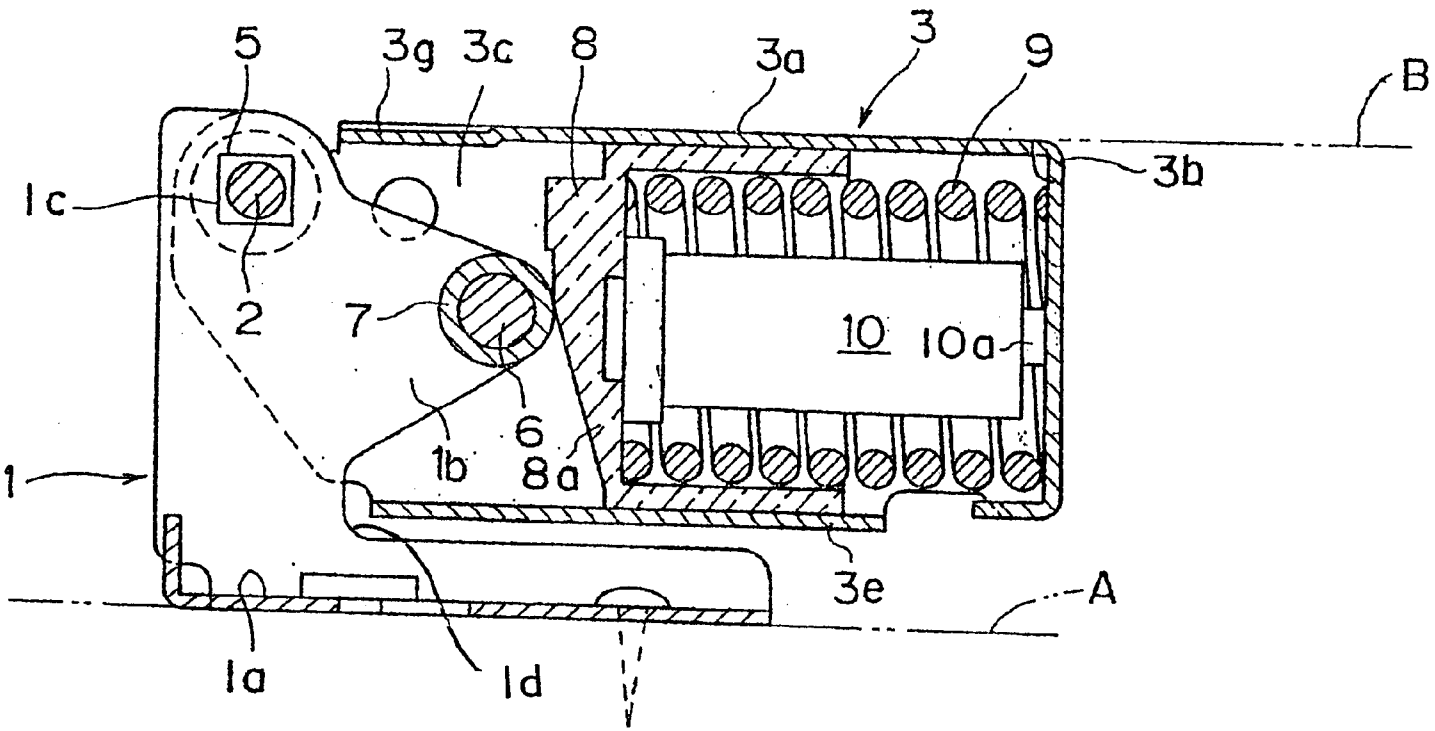
FIG. 9 is a side elevation, partially sectional, of a still another embodiment of the original pressing plate hinge according to the present invention.
Figure 10:
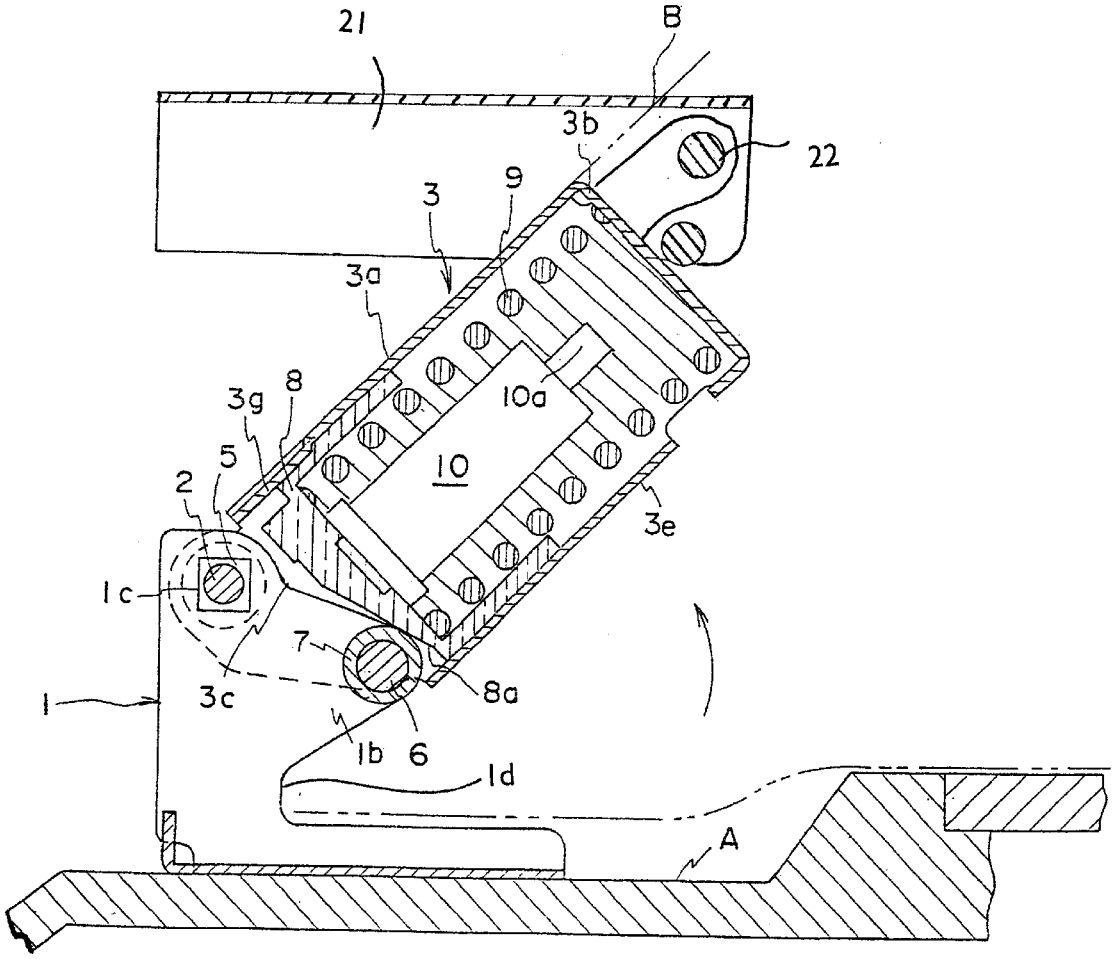
FIG. 10 is a side elevation, partially sectional, of the original pressing plate hinge in FIG. 9, when in an opened position.

Referring now to FIGS. 9 and 10, there is illustrated the third embodiment of the original pressing plate hinge according to the present invention. The third embodiment has a similar construction to that of the first embodiment shown in FIGS. 1 to 6, except for the following. Namely, in this third embodiment, the damping member 10 is not installed on the top plate 3*b* of the supporting member 3 but the fixing plate 14 is fixed to the cam slider 8 with the piston rod 10*a* directed towards the top plate 3*b*. No insertion hole is formed in the top plate 3*b* and the fixing plate is not fixed to the top plate 3*b*. As will be seen from FIG. 9, when the original pressing plate B is closed to a predetermined angular position, the end of the piston rod 10*a* abuts the top plate 3*b* to provide a damping effect against any abrupt closing of the original pressing plate B.

What is claimed is:

1. An original pressing plate hinge, comprising:

a fixing member consisting of a base plate, which is to be fixed to the body of an object provided with an original pressing plate and on which the hinge is to be used, opposite lateral plates rising from opposite lateral sides of the base plate;

a supporting member to support the original pressing plate and which consists of a back plate, top plate formed by bending the back plate, opposite lateral plates, and holding plates formed by bending the opposite lateral plates, one end of each of the opposite lateral plates of the supporting member being pivotably installed via a hinge pin to outsides of the opposite side plates of the fixing member;

a cam slider having one end thereof formed as a cam-shaped portion and which is slidably held by holding plates of the supporting member and directed towards the fixing member;

a pressure receiving pin supported between the opposite lateral plates of the fixing member in contact with the cam portion of the cam slider;

a coil spring provided resiliently between the cam slider and the top plate of the supporting member;

slots formed on the opposite lateral plates for receiving the holding plates when the supporting member is closed; and a lifting member for attaching to the original pressing plate, pivoted to a free end of the supporting member.

2. An original pressing plate hinge, comprising:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the free end of the supporting member; and a fluid damping member with a piston rod, removably inserted from the top plate of the supporting member into the coil spring, it being activated as a damper with the piston rod and caused to abut at the end thereof the cam slider when the supporting member is closed to a predetermined angular position as the original pressing plate is closed.

3. An original pressing plate hinge, comprising:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin being in contact with the cam portion of the cam slider and supported between the opposite lateral plates of the fixing member;

a coil spring provided resiliently between the cam slider and the free end of the supporting member; and a fluid damping member having a piston rod and inserted in the coil spring, it being activated as a damper with the piston rod caused to abut at the end thereof the cam slider when the supporting member is closed to a predetermined angular position as the original pressing plate is closed.

4. An original pressing plate hinge, comprising:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the top plate of the supporting member; and a fluid damping member with a piston rod and inserted in the coil spring, it being activated as a damper with the piston rod caused to abut at the end thereof the cam slider when the supporting member is closed to a predetermined angular position as the original pressing plate is closed.

5. An original pressing plate hinge, comprising:

a fixing member consisting of a base plate, which is to be fixed to the body of an object provided with an original pressing plate, and on which the hinge is to be used, and opposite lateral plates of the supporting member rising from opposite lateral sides of the base plate;

a supporting member to support the original pressing plate and which consists of a back plate, top plate formed by bending the back plate, and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the free end of the supporting member; and a fluid damping member having a piston rod and inserted between the cam slider in the coil spring and the free end of the supporting member, it being activated as a damper with the piston rod caused to abut at the end thereof the cam slider when the supporting member is closed to a predetermined angular position as the original pressing plate is closed.

6. An original pressing plate hinge, comprising:

a fixing member consisting of a base plate, which is to be fixed to the body of an object provided with an original pressing plate and on which the hinge is to be used, and opposite lateral plates rising from opposite lateral sides of the base plate;

a supporting member to support the original pressing plate and which consists of a back plate, top plate formed by bending the back plate and opposite lateral plates, one end of each of the opposite lateral plates of the supporting member being pivotably installed via a hinge pin to the opposite side plates of the fixing member;

a cam slider having one end thereof formed as a cam-shaped portion and which is slidably housed in the supporting member and directed towards the fixing member;

a pressure receiving pin supported between the opposite lateral plates of the fixing member in contact with the cam portion of the cam slider;

a coil spring provided resiliently between the cam slider and the top plate of the supporting member; and a fluid damping member with a piston rod, inserted between the cam slider in the coil spring and the top plate of supporting member, it being activated as a damper with the piston rod caused to abut at the end thereof the cam slider when the supporting member is closed to a predetermined angular position as the original pressing plate is closed.

7. The original pressing plate hinge as set forth in claim 1, 2, 3, 4, 5 or 6, wherein the supporting member further include a frictional portion which is put in contact with the cam slider when the supporting member is closed to a predetermined angular position as the original pressing plate is closed, thereby controlling the sliding movement of the cam slider.

8. The original pressing plate hinge as set forth in claims 1, 2, 3, 4, 5 or 6, wherein the fixing member has bearing members made of a non-conductive material and in which the hinge pin is pivotably supported, a conductive material shaped like a coil spring and being used to electrically connect the supporting member and fixing member to each other.

* * * * *